United States Patent [19]

Koller et al.

[11] 4,015,933

[45] Apr. 5, 1977

[54] PROCESS FOR DYEING BLENDED FABRICS

[75] Inventors: Stefan Koller, Ramlinsburg; Arnulf Ruediger Lapple, Arlesheim; Marielise Pacher, Munchenstein, all of Switzerland

[73] Assignee: Ciba-Geigy Corporation, Ardsley, N.Y.

[22] Filed: Apr. 24, 1975

[21] Appl. No.: 571,343

[30] Foreign Application Priority Data

Apr. 29, 1974 Switzerland ..... 5872/74

[52] U.S. Cl. ..... 8/21 A; 8/41 A; 8/54; 8/177 AB

[51] Int. Cl.[2] ..... D06P 3/82

[58] Field of Search ..... 8/21 A, 177 AB

[56] References Cited

UNITED STATES PATENTS

| | | | |
|---|---|---|---|
| 2,821,526 | 1/1958 | Boyd | 260/205 |
| 3,119,810 | 1/1964 | Sartori | 260/163 |
| 3,694,426 | 9/1972 | Doss | 260/156 |

FOREIGN PATENTS OR APPLICATIONS

| | | |
|---|---|---|
| 1,257,954 | 2/1961 | France |
| 2,050,246 | 5/1971 | Germany |
| 1,137,418 | 10/1962 | Germany |
| 914,074 | 12/1962 | United Kingdom |

*Primary Examiner*—Joseph L. Schofer
*Assistant Examiner*—A. L. Clingman
*Attorney, Agent, or Firm*—Joseph G. Kolodny; Edward McC. Roberts; Prabodh I. Almaula

[57] ABSTRACT

A process for dyeing and printing blends of wool and polyacrylic fibers which comprises the use of dyes of the formula wherein A is the radical of a monofunctional or polyfunctional tertiary amine, X is an anion and F is the radical of a dye of the disperse class.

16 Claims, No Drawings

PROCESS FOR DYEING BLENDED FABRICS

The invention provides a process for dyeing and printing blended fabrics in tone-in-tone shades wth a homogeneous dyestuff class.

The dyeing and printing of textile flat structures of fibre blends of different classes of fibre is gaining increasing importance. Blended fabrics of wool and polyacrylonitrile are dyed at present with dyestuff mixtures with acid or metal complex dyes being used for the wool and the conventional cationic dyes for the polyacrylonitrile content, i.e. two classes of dye which are poorly compatible. To prevent the precipitations which frequently occur when dyeing from a single bath, it is necessary either to convert the cationic dye content with strongly anionic assistants into soluble addition compounds or to keep the resultant precipitations in finest distribution wth dispersants, which is only possible with a few selected special dyestuff combinations.

Even for simple shades, it is necessary to use complicated dyestuff mixtures to obtain a uniform shade on both substrates (which is necessary for a level dyeing of the blended fabric), since a simple cationic dye virtually never has exactly the shade of the wool dye. In addition, dyestuff mixtures can only be adjusted to a quite specific mixture ratio of wool/acrylonitrile. If this ratio changes, differences in the depth of shade result on both substrates.

It is the object of the invention to provide a process for dyeing and printing blends of wool and acrylic fibres tone-in-tone which comprises the use of dyes of the formula $$F-O-\overset{\overset{\displaystyle O}{\|}}{C}-CH_2CH_2-A^+ \ldots X^-$$

wherein A is the radical of a monofunctional or polyfunctional tertiary amine, X is an anion F is the radical of a dye of the disperse class.

The dyes to be used according to the invention are known. They are obtained for example by reaction of disperse dyes containing acylatable hydroxy groups with $\beta$-halopropionic acid halides or $\alpha,\beta$-unsaturated acid halides in tertiary bases, e.g. by reaction with 2-bromopropionic chloride or bromide in the presence of a surplus of pyridine.

Examples of suitable azo dyes for carrying out the dyeing procedure are those of the formulae

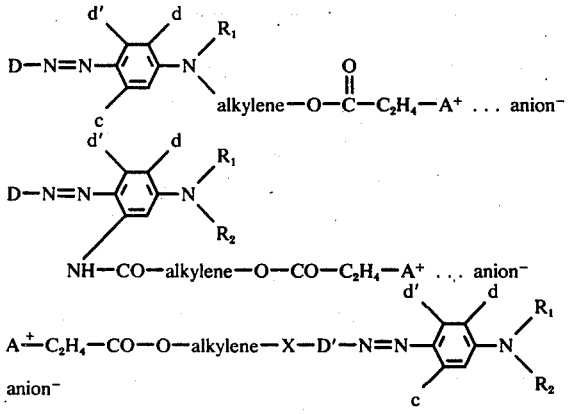

-continued

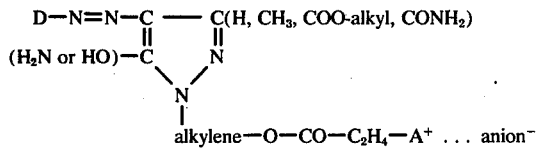

wherein D is the radical of a diazo component of the disperse class, D' is a phenylene radical which may contain non-ionic substituents, *c* and *d* are hydrogen, lower alkyl, lower alkoxy, chlorine or bromine, *c*, is additionally acylamino, above all lower alkylcarbonylamino, *d'* is hydrogen or lower alkylcarbonylamino, each of $R_1$ and $R_2$ is an unsubstituted or a substituted alkyl radical, e.g. benzyl, phenethyl, cyanoethyl, cyanoethoxyethyl, lower alkoxyalkyl, hydroxyalkyl, (lower alkyl- or arylcarbonylaminoalkyl), lower alkylcarbonyloxyalkyl, benzoyloxyalkyl, lower alkylcarbonylaminoalkyl, or lower alkylaminocarbonyloxyalkyl, and X is a radical of the formulae $$-SO_2-,\ -SO_2NH-,\ -NHSO_2-,\ -O-,\ -S-,$$

$$-CO-O-,\ -O-CO-\ \text{or}\ -O-CO-NH-.$$

Preferably D is a radical of the formula

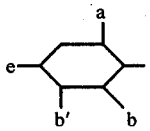

wherein e is lower alkyl, halogen, alkoxy, carbalkoxy, cyano, $CF_3$, $-SO_2-$lower alkyl, phenyl which is substituted or unsubstituted, $-NHSO_2-$lower alkyl, $$-\underset{\underset{\displaystyle O}{\|}}{C}-\text{phenyl},$$

$-N(\text{lower alkyl})-SO_2-$lower alkyl or $-CO-$lower alkyl, a has the same meaning as e but is preferably hydrogen, halogen bromine or chlorine), or cyano, b has the same meaning as e but is preferably hydrogen, lower alkyl, halogen (bromine or chlorine) or cyano, b' has the same meaning as e but is preferably hydrogen or halogen (bromine or chlorine).

The alkyl radicals cited in the preceding definition (as well as those in the form of alkoxy and carboxy radicals) contain in general not more than 4 carbon atoms.

Suitable radicals $A^+$are those of the formulae

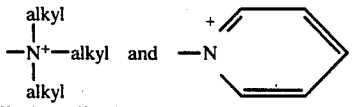

wherein alkyl radicals are methyl, ethyl, propyl and butyl, above all the trimethylammonium and pyridinium radicals, as well as those of the formulae

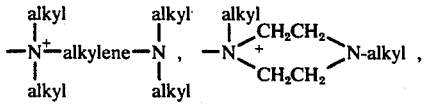

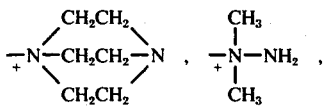

wherein the alkyl radicals can carry substituents, for example phenyl or alkoxycarbonyl groups and preferably contain not more than 8 carbon atoms. The alkylene radical normally contains at most 6 carbon atoms and the ethylene radical is preferred. The radicals A, which contain 2 nitrogen atoms, are introduced e.g. by reacting equimolar amounts of diamine with the $\beta$-bromopropionic acid ester of the dye.

The textile materials of wool and acrylic fibres to be dyed can be in any desired form, for example yarns or wovens. The acrylic content can vary from 5 to 95%.

Suitable acrylic fibres are polyacrylonitrile and polyvinylidene cyanide fibres ("Darvan"). By polyacrylonitrile fibres (or "arylics") are meant in the narrower sense polymers which contain more than 80%, e.g. from 80 to 95%, of acrylonitrile; in addition they contain 5 to 20% of vinyl acetate, vinyl pyridine, vinyl chloride, vinylidene chloride, acrylic acid, acrylic esters, methacrylic acid, methacrylic esters etc.

The dyeing is carried out at 80° to 120° C, preferably at 90° to 108° C. If the dyeing is carried out at temperatures above 180° C, then it is necessary to add protective agents for wool, i.e. for example compounds which effect a cross-linking action on the wool. Protective agents for wool are, for example, compounds which liberate formaldehyde under the dyeing conditions.

It is also of advantage to add levelling agents and/or retarders such as are used for dyeing acrylic fibres, e.g. adducts of ethyleneoxy and octyl phenol, castor oil, higher alcohols (e.g. $C_{16}H_{33}OH$), dodecyl thiol, polyamides or higher fatty amines (e.g. $C_{12}H_{22}NH_2$ or $C_{18}H_{37}NH_2$). Cationic and anionic retarders are described e.g. in the Journal of the Society of Dyers and Colourists, vol. 84, No. 5, pp. 257–261.

The dyeing is carried out at pH values of 2 to 8 or 3 to 8, preferably 4 to 6, but with particular advantage 3 to 5.

The dyeings obtained according to the present invention can be subjected to an aftertreatment, e.g. by heating with an aqueous solution of a non-ionic detergent.

The dyes used according to the invention can also be applied to the acrylic/wool blends by printing using the assistants conventionally employed in printing besides those mentioned hereinbefore, especially wetting agents and thickeners.

The following Examples illustrate the invention, the parts and percentages being by weight unless otherwise indicated.

EXAMPLE 1

1 g of the dye of the formula

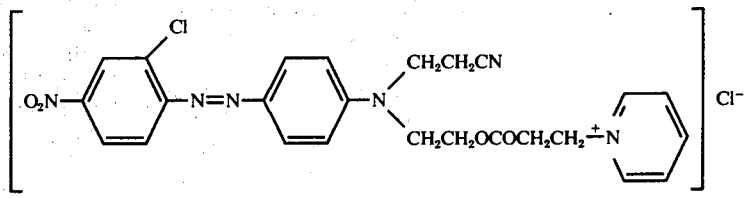

is dissolved in one liter of water of 50° C and 2 g of sodium acetate are added to this solution. The pH is adjusted to 4-5 with glacial acetic acid. Then 100 g of a blended fabric consisting of polyacrylonitrile/wool (50:50) are put into this dyebath and dyeing is performed in a sealed apparatus with the temperature being raised within 30 minutes to 150° C. After a dyeing time of 90 minutes, the bath is cooled to 70° C. The goods are rinsed with warm water and then dried. A level tone-in-tone dyeing is obtained. No assistants were required.

EXAMPLE 2

0.7 g of the dye of the formula

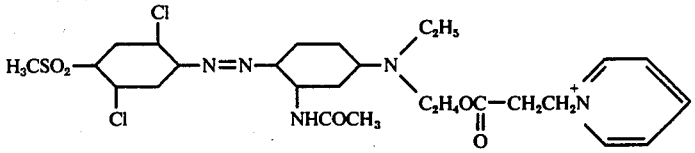

is dissolved in 2 liters of water of 50° and 2 g of sodium formiate as well as 0.5 g of a mixture consisting of the ammonium salt of the acid sulphuric acid ester of a reaction product of a fatty acid amine ($C_{18}$-$C_{22}$) and 30 moles of ethylene oxide and the reaction product of a fatty acid amine ($C_{18}$-$C_{22}$) and 20 moles of ethylene oxide which is quaternised with dimethyl sulphate are added to this solution. The pH is adjusted to 3 with 85% formic acid. Then 100 g of a blended fabric consisting of polyacrylonitrile/wool (55:45) are put into this dyebath and dyeing is performed in a sealed apparatus with the temperature being raised within 30 minutes to 70° C. After a dyeing time of 60 minutes the bath is cooled to 70° C. The goods are rinsed with warm water and then dried. A level, red dyeing of good fastness to light, washing, water and perspiration and with very good tone-in-tone shades is obtained.

Similar results are obtained with the following dyes of the general formula

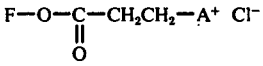

wherein F and A have the meanings already assigned to them.

| | dye | A | shade on polyacryl-onitrile/wool |
|---|---|---|---|
| 3 | 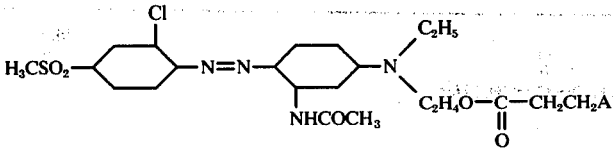 | 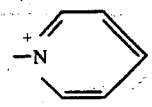 | orange |
| 4 | 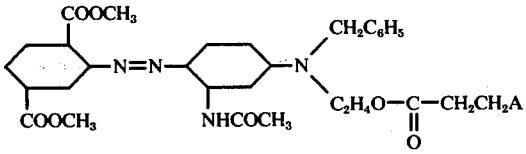 | " | yellowish orange |
| 5 | 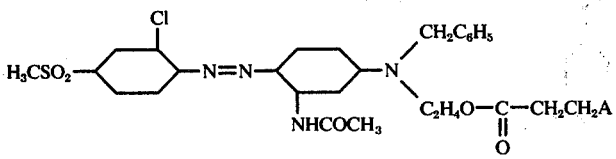 | " | orange |
| 6 | 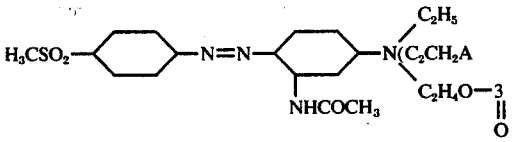 | " | yellowish orange |
| 7 | 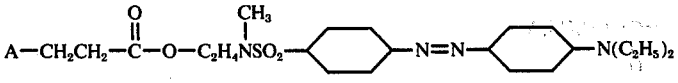 | " | golden yellow |
| 8 | 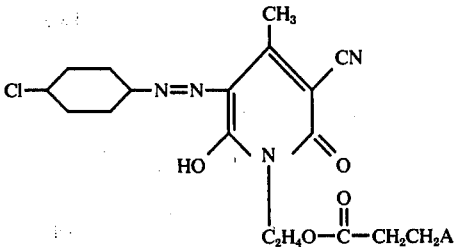 | " | greenish yellow |
| 9 | 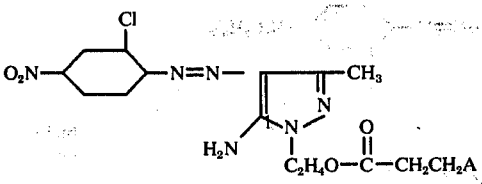 | " | orange |
| 10 | 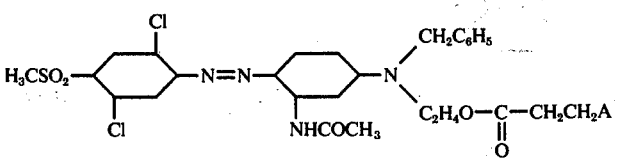 | " | red |
| 11 | 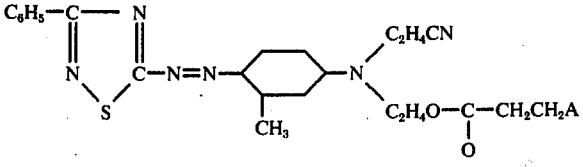 | " | red |
| 12 | 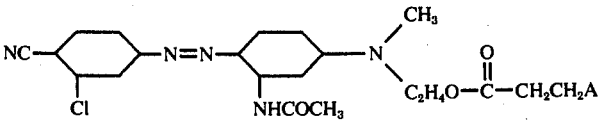 | " | yellowish red |

-continued
| | dye | A | shade on polyacryl-onitrile/wool |
|---|---|---|---|
| 13 | 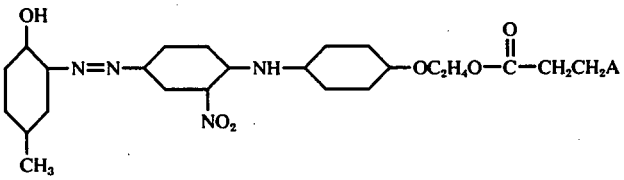 | " | golden yellow |
| 14 | 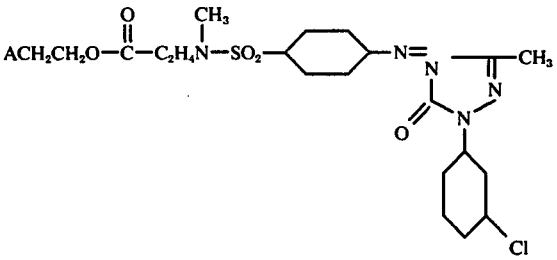 | " | yellow |
| 15 | 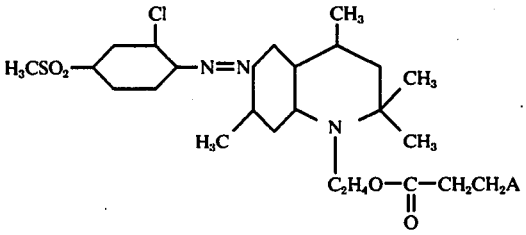 | " | red |
| 16 | 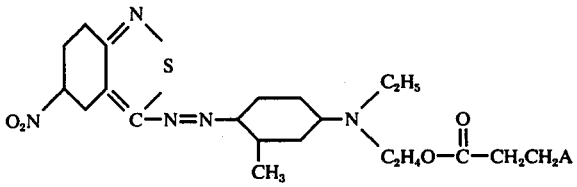 | " | blue |
| 17 | 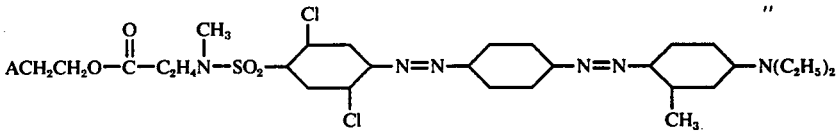 | " | red |
| 18 | 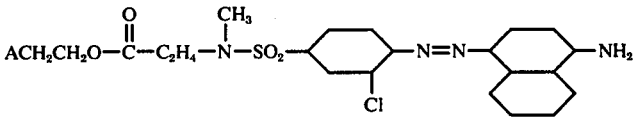 | " | bluish red |
| 19 | 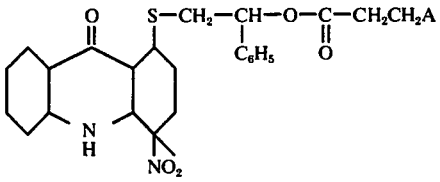 | " | yellow |
| 20 | 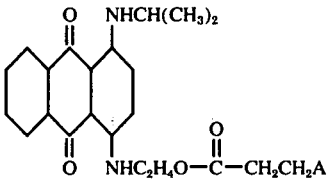 | " | blue |

-continued
| | dye | A | shade on polyacryl-onitrile/wool |
|---|---|---|---|
| 21 | 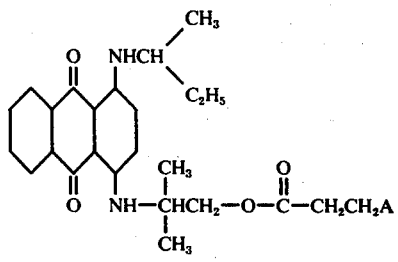 | " | blue |
| 22 | 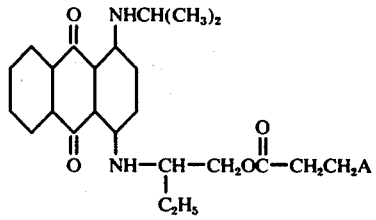 | " | blue |
| 23 | 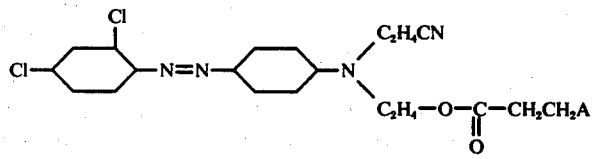 | 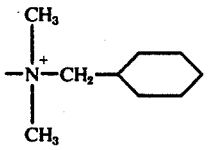 | yellow |
| 24 | " | 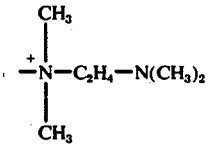 | " |
| 25 | " | 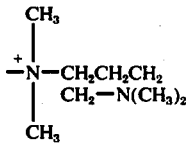 | " |
| 26 | " | 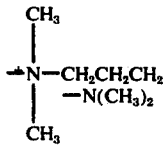 | " |
| 27 | " | $-\overset{+}{N}(C_2H_5)_3$ | " |
| 28 | 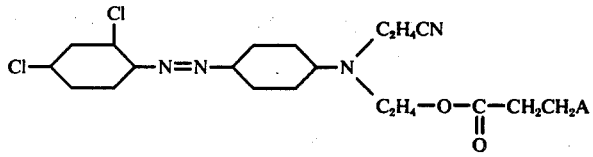 | 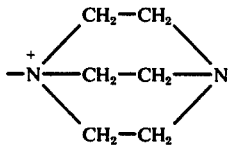 | yellow |
| 29 | " | 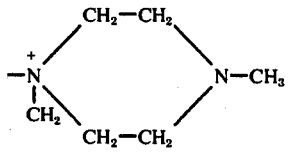 | " |
| 30 | " | 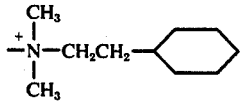 | " |

-continued

| | dye | A | shade on polyacryl-onitrile/wool |
|---|---|---|---|
| 31 | " | $-\overset{+}{N}(CH_3)(C_2H_5)-C_2H_5$ | " |
| 32 | " | $-\overset{+}{N}(CH_3)(CH_3)-C_2H_4-CO-O-CH_3$ | " |

We claim:

1. A process for dyeing or printing a blend of wool and polyacrylic fibers which comprises the step of applying to the fibers a dye of the formula $$F-O-\overset{O}{\overset{\|}{C}}-CH_2CH_2-A^+ \ldots X^-$$

wherein A is of the formulas

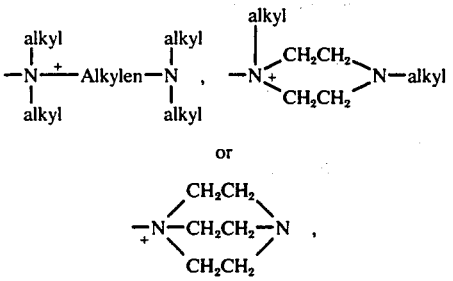

X is an anion and F is the radical of a dye of the disperse class.

2. A process according to claim 1 wherein F is a radical of an azo dye.

3. A process according to claim 2 wherein F is of the formula

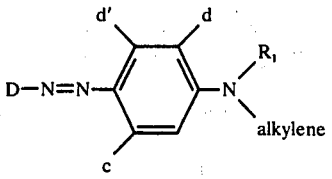

wherein D is the radical of a diazo component of the disperse class, *c* and *d* are hydrogen, lower alkyl, lower alkoxy, chlorine or bromine, c is additionally acylamino, above all lower alkylcarbonylamino, *d'* is hydrogen or lower alkylcarbonylamino, and $R_1$ is an unsubstituted or a substituted alkyl radical.

4. A process according to claim 2 wherein F is of the formula

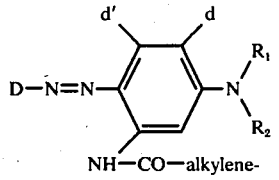

wherein *d* is hydrogen, lower alkyl, lower alkoxy, chlorine or bromine, *d'* is hydrogen or lower alkylcarbonylamino, D is the radical of a diazo component of the disperse class, and $R_1$ and $R_2$ are the same and are an unsubstituted or a substituted alkyl radical.

5. A process according to claim 2 wherein F is of the formula

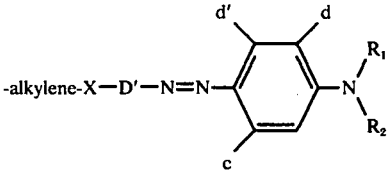

wherein *d* is hydrogen, lower alkyl, lower alkoxy, chlorine or bromine, *d'* is hydrogen or lower alkylcarbonylamino, c is hydrogen, lower alkyl, lower alkoxy, chlorine, bromine, or lower alkylcarbonylamino, D' is a phenylene radical which may contain non-ionic substituents and X is a radical of the formulae $-SO_2-$, $-SO_2NH-$, $-NHSO_2-$, $-O-$, $-S-$, $-CO-O-$, $-O-CO-$or $-O-CO-NH$.

6. A process according to claim 2 wherein F is of the formula

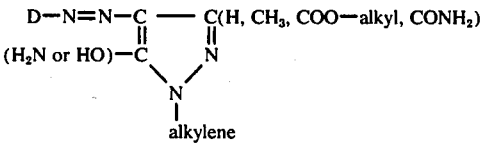

wherein D is the radical of a diazo component of the disperse class.

7. A process according to claim 3, wherein $F_1$ is benzyl, phenethyl, cyanoethyl, cyanoethoxyethyl, lower alkoxyalkyl, hydroxyalkyl, (lower alkylor arylcarbonylaminoalkyl), lower alkylcarbonyloxyalkyl, benzoyloxyalkyl, lower alkylcarbonylaminoalkyl or lower alkylaminocarbonyloxyalkyl.

8. A process according to claim 1, wherein the dyeing is carried out at 80° to 120° C.

9. A process according to claim 1 which comprises the use of levelling agents and/or retarders.

10. A process according to claim 1, wherein the dyeing is carried out at pH values of 2 to 8.

11. A process according to claim 1, wherein the dyeing is carried out at pH values of 3 to 8.

12. A process according to claim 11, wherein the dyeing is carried out at pH values of 4 to 6.

13. A process according to claim 11, wherein the dyeing is carried out at pH values of 3 to 5.

14. The blended fabrics dyed or printed according to the process of claim 1.

15. A process according to claim 4, wherein $R_1$ and $R_2$ are benzyl, phenethyl, cyanoethyl, cyanoethoxyethyl, lower alkoxyalkyl, hydroxyalkyl, (lower alkyl- or arylcarbonylaminoalkyl), lower alkylcarbonyloxyalkyl, benzoyloxyalkyl, lower alkylcarbonylaminoalkyl or lower alkylaminocarbonyloxyalkyl.

16. A process according to claim 5, wherein $R_1$ and $R_2$ ae benzyl, phenethyl, cyanoethyl, cyanoethoxyethyl, lower alkoxyalkyl, hydroxyalkyl, (lower alkyl- or arylcarbonylaminoalkyl), lower alkylcarbonyloxyalkyl, benzoyloxyalkyl, lower alkylcarbonylaminoalkyl or lower alkylaminocarbonyloxyalkyl.

* * * * *

UNITED STATES PATENT OFFICE

CERTIFICATE OF CORRECTION

PATENT NO. : 4,015,933

DATED : April 5, 1977

INVENTOR(S) : STEFAN KOLLER ET AL

It is certified that error appears in the above-identified patent and that said Letters Patent are hereby corrected as shown below:

Column 12, claim 7, line 61, change "$F_1$" to -- $R_1$ --, and in line 63, change "alkylor" to -- alkyl or --.

Column 14, claim 16, line 8, change "ae" to -- are --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*